United States Patent [19]

Akasaki et al.

[11] Patent Number: 5,028,505

[45] Date of Patent: Jul. 2, 1991

[54] ELECTROPHOTOGRAPHIC PHOTORECEPTOR

[75] Inventors: Yutaka Akasaki; Katsumi Nukada; Katsuhiro Sato, all of Kanagawa, Japan

[73] Assignee: Fuji Xerox Co., Ltd., Tokyo, Japan

[21] Appl. No.: 436,617

[22] Filed: Nov. 15, 1989

[30] Foreign Application Priority Data

Nov. 16, 1988 [JP] Japan ..... 53-287615
Nov. 16, 1988 [JP] Japan ..... 53-287616
Nov. 16, 1988 [JP] Japan ..... 53-287619

[51] Int. Cl.[5] ..... G03G 5/14
[52] U.S. Cl. ..... 430/58; 430/59; 430/95
[58] Field of Search ..... 430/95, 58, 59

[56] References Cited

U.S. PATENT DOCUMENTS 4,106,934 8/1978 Turnblom ..... 430/58

FOREIGN PATENT DOCUMENTS 48-9988 3/1973 Japan .
54-30834 3/1979 Japan .

*Primary Examiner*—David Welsh
*Attorney, Agent, or Firm*—Finnegan, Henderson, Farabow, Garrett and Dunner

[57] ABSTRACT

An electrophotographic photoreceptor is disclosed, comprising a conductive substrate having thereon a photosensitive layer, wherein the photosensitive layer comprises at least one compound selected from the group consisting of a compound of formula (I), a compound of formula (II), and a compound of formula (III) as defined below:

(I)

wherein $X^I$ represents a cyano group, an alkoxycarbonyl group, or an aryloxycarbonyl group; $R^I_1$ and $R^I_2$ each represents a hydrogen atom, an alkyl group, an aryl group, an alkoxycarbonyl group, an aryloxycarbonyl group, an alkylcarbonyl group, an arylcarbonyl group, a nitro group, a halogen atom, or a cyano group; $A^I$ represents wherein $R^I_3$ and $R^I_9$ each represents a hydrogen atom, an alkyl group, a nitro group, a halogen atom, or a cyano group; and m and n each represents an integer of 0 to 3;

(II)

wherein $X^{II}$ represents O, $C(CN)_2$ or $C(CO_2R^{II})_2$, wherein $R^{II}$ is an alkyl group; $R^{II}_1$ and $R^{II}_2$ each represents a hydrogen atom, an alkyl group, an aryl group, an alkoxycarbonyl group, an aryloxycarbonyl group, a nitro group, a halogen atom, or a cyano group; and m' and n' each represents an integer of 0 to 2; and (III)

wherein $R^{III}_1$ and $R^{III}_2$ each represents a hydrogen atom, an alkyl group, an aryl group, an alkoxycarbonyl group, an aryloxycarbonyl group, an alkylcarbonyl group, an arylcarbonyl group, a nitro group, a halogen atom, or a cyano group, $A^{III}$ represents (1)

-continued
(2)
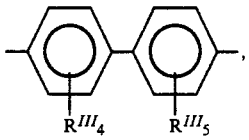
(3)
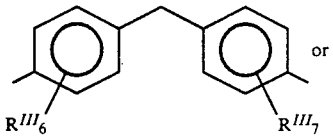
wherein $R^{III}_3$ and $R^{III}_9$ each represents a hydrogen atom, an alkyl group, a nitro group, a halogen atom, or a cyano group; and m'' and n'' each represents an integer of 0 to 3.
-continued
(4)
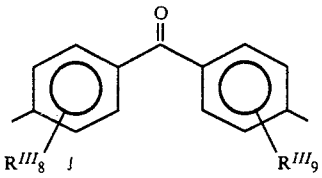
10 Claims, No Drawings

ELECTROPHOTOGRAPHIC PHOTORECEPTOR

FIELD OF THE INVENTION

The present invention relates to an electrophotographic photoreceptor for forming an electrostatic latent image.

BACKGROUND OF THE INVENTION

Research has been conducted on an electrophotographic photoreceptor containing organic photoconductive materials because it offers several advantages such as no environmental pollution, higher productivity, and lower costs. There is a prior art electrophotographic photoreceptor which comprises a photosensitive layer containing diphenyldicyanoethylene derivatives as a sensitizer. Such an electrophotographic photoreceptor is disclosed in, for example, JP-A-54-30834 (the term "JP-A" as used herein means an "unexamined published Japanese patent application").

A problem with such use of organic photoconductive materials is present that a material which absorbs visible light to generate a charge exhibits poor charge retaining capacity; in contrast, a material which exhibits good charge retaining capacity and excellent film forming properties barely exhibits photoconductive properties by visible light.

To overcome such problems, use of a photosensitive layer of a laminate type composed of a layer containing a charge generating agent which absorbs visible light to generate charges and another layer containing a charge transporting agent to transport the charges produced has been attempted. Various charge generating agents and charge transporting agents have been suggested. For example, when the charge transporting agent is the hole transporting agent type, amine compounds, hydrazone compounds, pyrazoline compounds, oxazole compounds, oxadiazole compounds, stilbene compounds, or carbazole compounds may be used. Also, it is known that 2,4,7-trinitrofluorenone is an electron transporting agent type in the charge transporting agent. In addition, JP-B-48-9988 (the term "JP-B" as used herein means an "examined Japanese patent publication") and Canadian Patent 912019 disclose a compound containing boron as a charge transporting agent.

In prior art electrophotographic photoreceptors comprising a single photosensitive layer containing organic photoconductive materials, a completely practical sensitizer has not been found.

In a function separated type electrophotographic photoreceptor comprising laminated photosensitive layers, it is preferred that a positive charged type be used because the generation of ozone in Corotron is prevented, and toner charges are controlled upon development. When an electrophotographic photoreceptor is of the positive charged type, and when a charge transporting agent is a hole transporting agent, it is necessary to use a charge generating layer as an upper layer. However, because the custom is to make the charge generating layer thin, the problem arises that such a thin charge generating layer is insufficient to meet the mechanical requirements of an electrophotographic photoreceptor. Also, it would be commercially advantageous to improve the properties of a positive charged type electrophotographic photoreceptor because otherwise it would be necessary to devise a copying machine capable of using a negative charged one.

On the other hand, there is a need for an electrophotographic photoreceptor of a positive charged type in which a considerably thick charge transporting layer constitutes the upper layer. To this end, it is necessary to use a charge transporting layer containing charge transporting agent having an electron transporting property. However, among conventional charge transporting agents having an electron transporting property, there are not known those which are fully practical.

SUMMARY OF THE INVENTION

The present invention is intended to overcome the above-noted problems inherent in the prior art.

Accordingly, an object of the present invention is to provide an electrophotographic photoreceptor having excellent electrophotographic properties.

Another object of the present invention is to provide a laminate type electrophotographic photoreceptor which is used under a positive charged state, and exhibits excellent electrophotographic properties.

The present inventors have discovered that when at least one compound selected from the group consisting of a compound represented by formula (I), a compound represented by formula (II), and a compound represented by formula (III) is used as a sensitizer or a charge transporting agent, an electrophotographic photoreceptor having excellent electrophotographic properties can be obtained.

To achieve the above objects, the present invention provides an electrophotographic photoreceptor comprising a conductive substrate having thereon a photosensitive layer, wherein the photosensitive layer comprises as a charge transporting agent at least one compound selected from the group consisting of a compound of formula (I), a compound of formula (II), and a compound of formula (III). The compound of formula (I) is as follows:

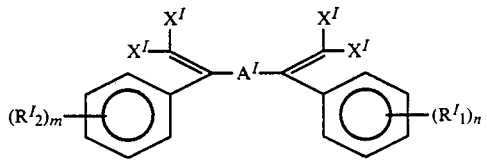

(I)

wherein $X^I$ represents a cyano group, an alkoxycarbonyl group, or an aryloxycarbonyl group; $R_1^I$ and $R_2^I$ each represents a hydrogen atom, an alkyl group, an aryl group, an alkoxycarbonyl group, an aryloxycarbonyl group, an alkylcarbonyl group, an arylcarbonyl group, a nitro group, a halogen atom, or a cyano group; and $A^1$ represents

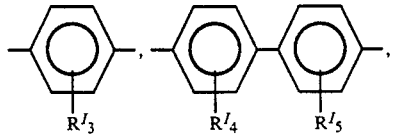

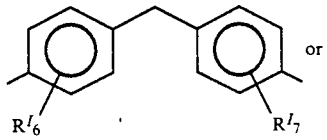

-continued

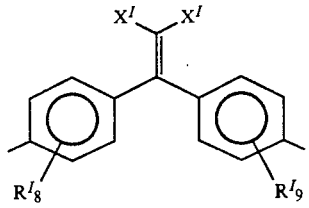

wherein $R_3^I$ to $R_9^I$ each represents a hydrogen atom, an alkyl group, a nitro group, a halogen atom, or a cyano group; and m and n each represents an integer of 0 to 3.

The compound of formula (II) is as follows:

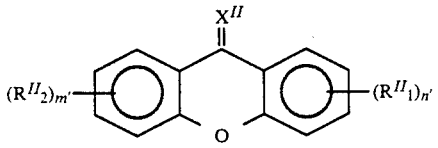

(II)

wherein $X^{II}$ represents O, $C(CN)_2$ or $C(CO_2R^{II})_2$ (wherein $R^{II}$ is an alkyl group); $R_1^{II}$ and $R_2^{II}$ each represents a hydrogen atom, an alkyl group, an aryl group, an alkoxycarbonyl group, an aryloxycarbonyl group, a nitro group, a halogen atom, or a cyano group; and m' and n' each represents an integer of 0 to 2.

The compound of formula (III) is as follows:

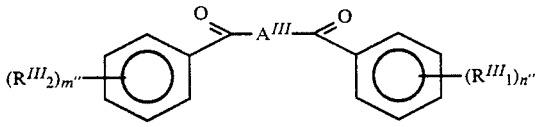

(III)

wherein $R_1^{III}$ and $R_2^{III}$ each represents a hydrogen atom, an alkyl group, an aryl group, an alkoxycarbonyl group, an aryloxycarbonyl group, an alkylcarbonyl group, an arylcarbonyl group, a nitro group, a halogen atom, or a cyano group; and $A^{III}$ *represents*

(1)

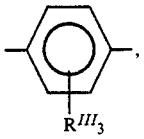

(2)

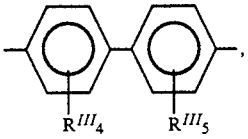

(3)

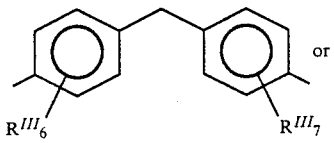

-continued (4)

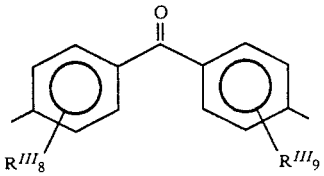

wherein $R_3^{III}$ to $R_9^{III}$ each represents a hydrogen atom, an alkyl group, a nitro group, a halogen atom, or a cyano group; and m'' and n'' each represents an integer of 0 to 3.

For the compounds of formulas (I), (II), and (III), the alkyl group described above preferably has 1 to 10 carbon atoms; the aryl group described above preferably has 6 to 25 carbon atoms; the alkoxycarbonyl group described above preferably has 2 to 11 carbon atoms; the aryloxycarbonyl group described above preferably has 7 to 26 carbon atoms; the arylcarbonyl group described above preferably has 7 to 26 carbon atoms; and the alkylcarbonyl group described above has 2 to 11 carbon atoms.

DETAILED DESCRIPTION OF THE INVENTION

Examples of the compounds represented by formula (I) include but are not limited to the following:

I-(1)

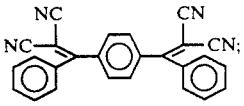

I-(2)

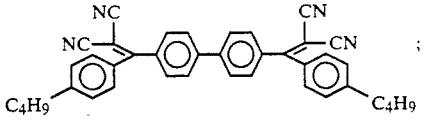

I-(3)

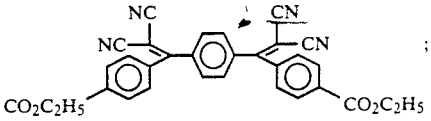

I-(4)

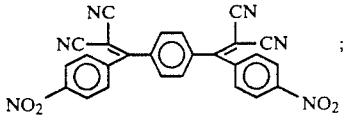

I-(5)

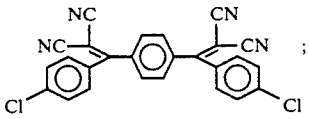

I-(6)

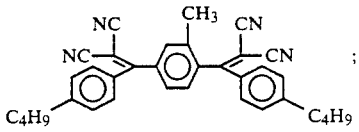

I-(7)

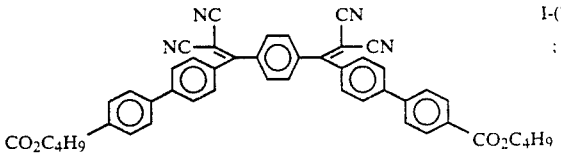

-continued

I-(8)

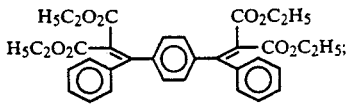

I-(9)

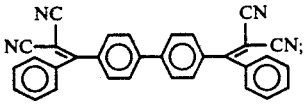

I-(10)

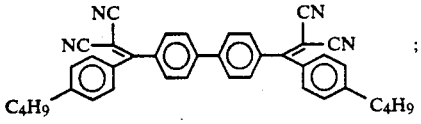

I-(11)

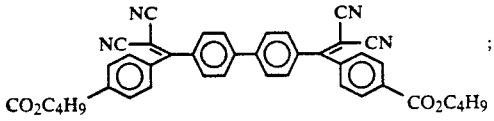

I-(12)

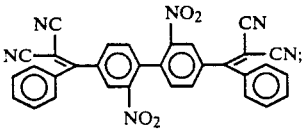

I-(13)

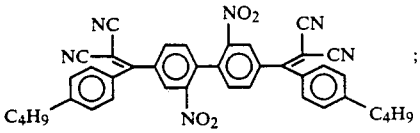

I-(14)

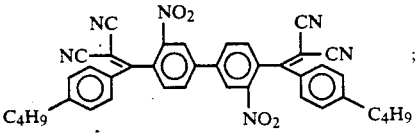

I-(15)

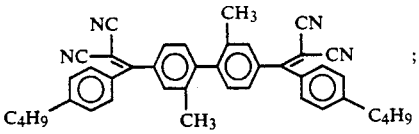

I-(16)

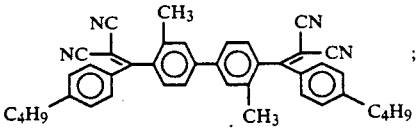

I-(17)

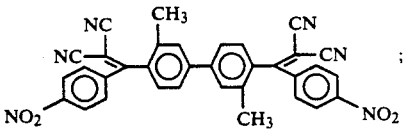

I-(18)

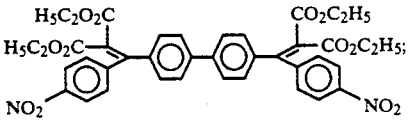

I-(19)

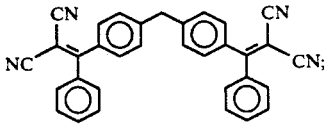

-continued

I-(20)

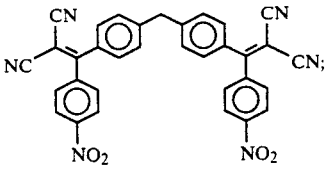

I-(21)

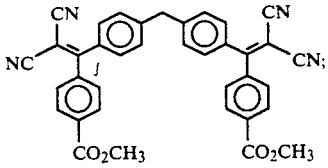

I-(22)

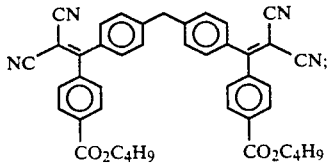

I-(23)

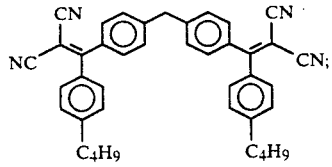

I-(24)

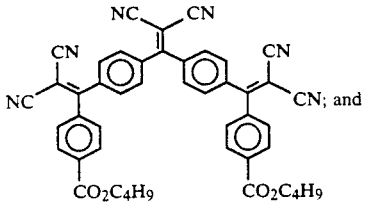

I-(25)

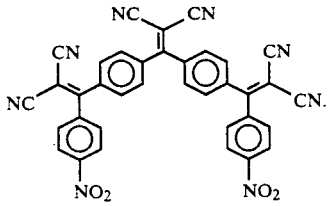

Of the compounds represented by formulae I-(1) to I-(25), the compound of formula I-(20) is preferred.

These compounds represented by formula (I) can be readily obtained as shown in the following reaction equation. In particularly, compounds represented by formula (Io) and malonitrile are heated under reflux in a solvent such as pyridine to form compounds represented by formula (I'o) which, if desired, are hydrolyzed, and undergo esterification or undergo condensation with malonic acid ester, thereby forming the compounds represented by formula (I).

(Io)

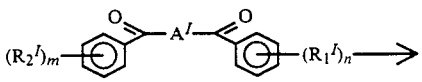

(I'o)

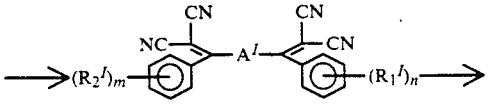

-continued (I)

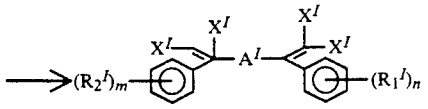

wherein $R_1^I$, $R_2^I$, $A^I$, $X^I$, m, and n are previously defined in formula (I).

The following examples illustrate the various methods to prepare the compounds represented by formula (I). Although, only a few of the compounds encompassed by formula (I) are illustratively prepared below, method similar to the methods described below can be used to synthesize the other compounds of formula (I).

I. Synthesis examples involving compounds of formula (I)

I-A. Synthesis of compound I-(20).

A compound having the following formula was made by a condensation reaction between p-nitrobenzoyl chloride and diphenylmethane:

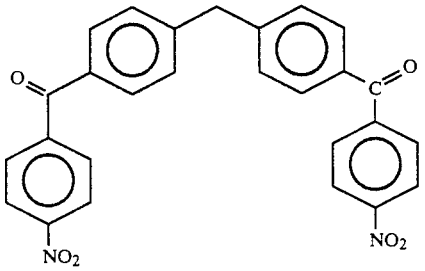

Into a 100 ml, three-necked, flask were poured 10.0 g (21.4 mmol) of the compound thus prepared above, 5.7 g (85.8 mmol) of malonitrile, and 80 ml of pyridine. The reaction mixture was refluxed in a stream of nitrogen for 3 hours, followed by removal of the pyridine under reduced pressure. The residue was dissolved in methylene chloride, and then washed with successive, dilute hydrochloric acid, and water, followed by drying with $Na_2SO_4$. The dried product was then purified by the use of a short column of silica gel (in which methylene chloride was used as a solvent). After removal of the solvent, recrystallization from ethyl acetate gave 5.3 g (a 44.1% yield) of the compound I-(20) as light pink acicular crystals, the melting point of which was 226° to 228° C.

I-B. Synthesis of compound I-(2).

Compounds I-(2) was produced as light yellow tabular crystals in the same manner as in synthesis example I-A except that a compound having the following formula, which was produced by a condensation reaction between terephthaloyl chloride and n-butylbenzene, was used:

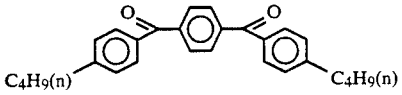

The compound I-(2) thus produced had a melting point of 201° to 202.5° C.

I-C. Synthesis of compound I-(13).

Compound I-(13) was produced as light yellow powders in the same manner as in synthesis example I-A except that a compound having the following formula, which was produced by a condensation reaction between 2,2'-dinitrobiphenyl-4,4'-carboxylic acid chloride and n-butylbenzene, was used:

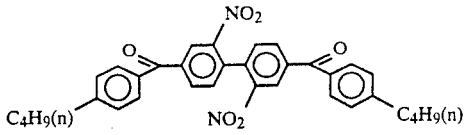

The compound I-(13) thus produced had a melting point of 231° to 232° C.

Examples of the compounds represented by formula (II) include but are not limited to the following:

II-(1)

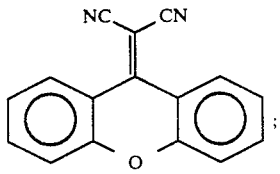

II-(2)

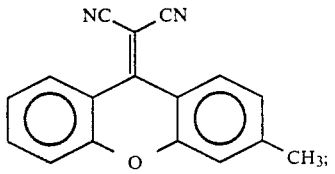

II-(3)

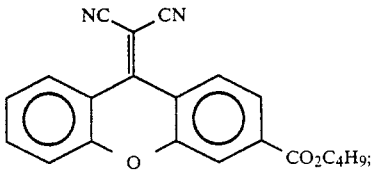

II-(4)

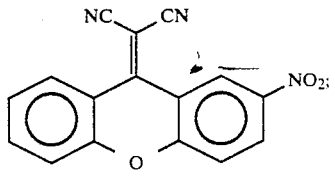

II-(5)

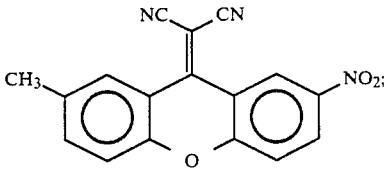

II-(6)

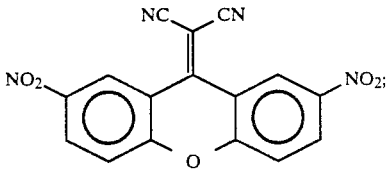

II-(7)

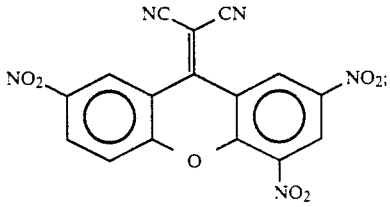

-continued

II-(8)

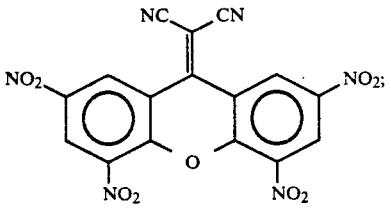

II-(9)

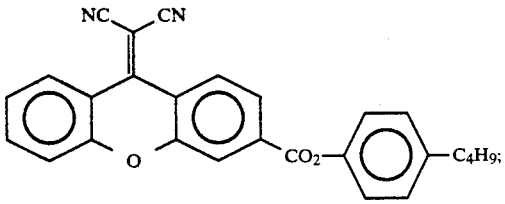

II-(10)

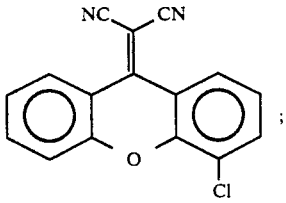

II-(11)

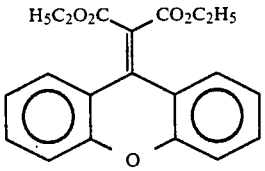

II-(12)

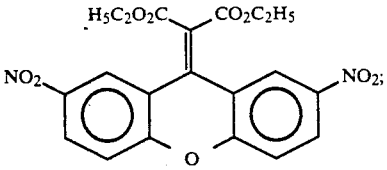

II-(13)

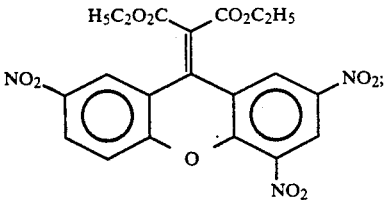

II-(14)

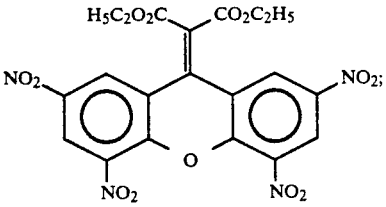

II-(15)

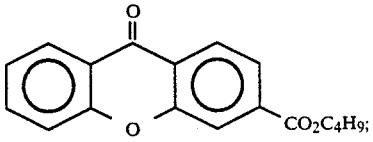

-continued

II-(16)

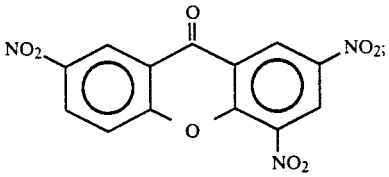

II-(17)

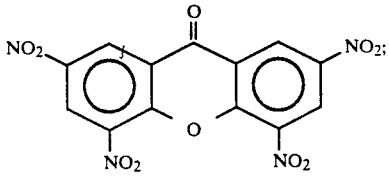

II-(18)

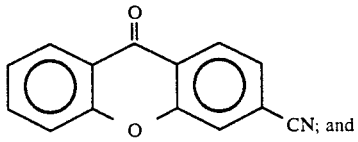

II-(19)

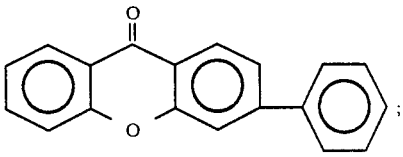

Of the compounds represented by formulae II-(1) to II-(19), the compound of formula II-(1) is preferred.

The compounds represented by formula (II) can be synthesized by various methods. For example, the compounds wherein $X^{II}$ is $C(CN)_2$ can be synthesized by treating xanthone derivatives with thionyl chloride, followed by reaction with malonitrile. The compounds in which $X^{II}$ is $C(CO_2R^{II})_2$ can be made by hydrolyzing a compound wherein $X^{II}$ is $C(CN)_2$, followed by esterification.

The following is a synthesis example illustrating the preparation of a compound of formula (II). However, although only one of the compounds encompassed by formula (II) is illustratively prepared below, methods similar to the method described can be used to synthesize the other compounds of formula (II).

II. Synthesis example involving a compound of formula (II)

II-A. Synthesis of compound II-(1).

Into a 200 ml round-bottomed flask were placed 20 g of xanthone and 100 ml of thionyl chloride. The reaction mixture was stirred under a stream of nitrogen for 3 hours, followed by removal of the thionyl chloride under reduced pressure. To the residue was added 10 g of malonitrile. This mixture was heated to 100° C for one hour with vigorous stirring, followed by cooling, and by dissolving the mixture in methylene chloride. The resulting methylene chloride solution was purified by the use of a short column of silica gel, followed by removal of the methylene chloride under reduced pressure. The residue was washed twice with small amounts of cold ethyl acetate. Finally, recrystallization from toluene gave 15.1 g (a yield of 61%) of compound II-(1) as yellow powders, a melting point of 252°-255° C.

Examples of the compounds represented by formula (III) include but are not limited to the following:

III-(1)
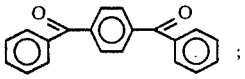
;
III-(2)
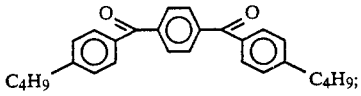
$C_4H_9$ $C_4H_9$;
III-(3)
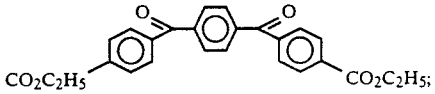
$CO_2C_2H_5$ $CO_2C_2H_5$;
III-(4)
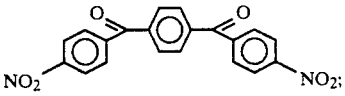
$NO_2$ $NO_2$;
III-(5)
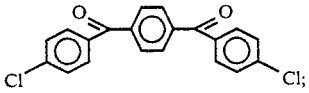
Cl Cl;
III-(6)
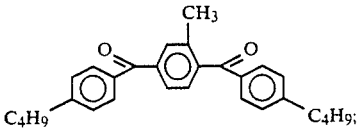
$CH_3$ $C_4H_9$ $C_4H_9$;
III-(7)
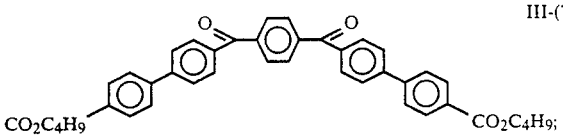
$CO_2C_4H_9$ $CO_2C_4H_9$;
III-(8)
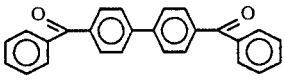
;
III-(9)
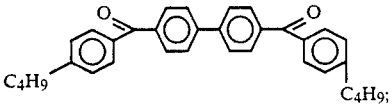
$C_4H_9$ $C_4H_9$;
III-(10)
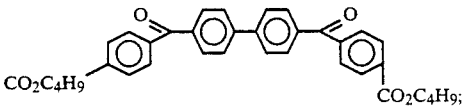
$CO_2C_4H_9$ $CO_2C_4H_9$;
III-(11)
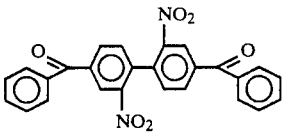
$NO_2$ $NO_2$ ;
III-(12)
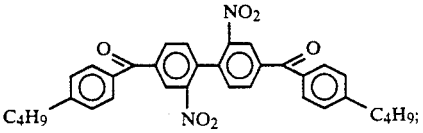
$NO_2$ $C_4H_9$ $NO_2$ $C_4H_9$;
III-(13)
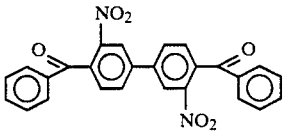
$NO_2$ $NO_2$ ;
-continued
III-(14)
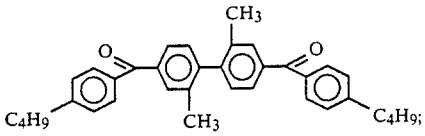
$CH_3$ $C_4H_9$ $CH_3$ $C_4H_9$;
III-(15)
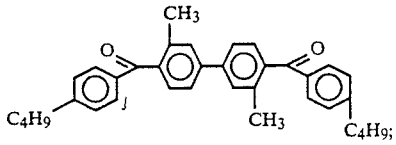
$CH_3$ $C_4H_9$ $CH_3$ $C_4H_9$;
III-(16)
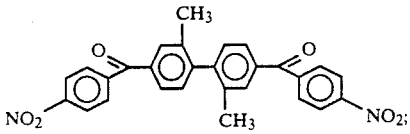
$CH_3$ $NO_2$ $CH_3$ $NO_2$;
III-(17)
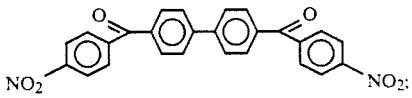
$NO_2$ $NO_2$;
III-(18)
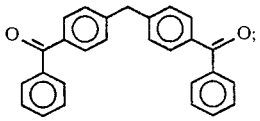
;
III-(19)
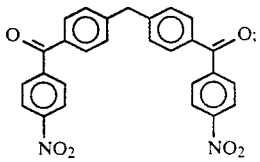
$NO_2$ $NO_2$;
III-(20)
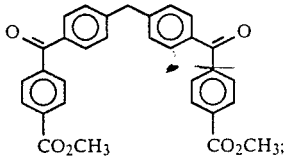
$CO_2CH_3$ $CO_2CH_3$;
III-(21)
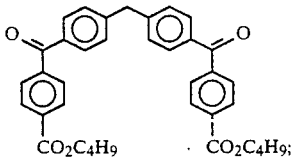
$CO_2C_4H_9$ $CO_2C_4H_9$;
III-(22)
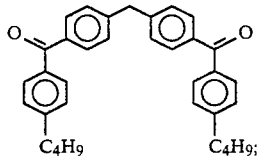
$C_4H_9$ $C_4H_9$;
III-(23)
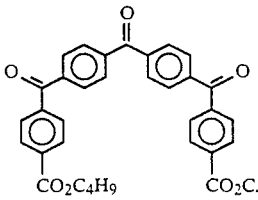
$CO_2C_4H_9$ $CO_2C_4H_9$; and -continued

III-(24)

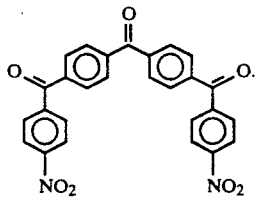

Of the compounds represented by formulae III-(1) to III-(24), the compound of formulae III-(12) and III-(19) are preferred.

The compound represented by formula (III) can be synthesized by various methods. For example, the compound wherein $A^{III}$ is constituent (1) or constituent (2) of formula (III) can be produced by a condensation reaction between terephthaloyl chloride derivatives or biphenyl-4,4'-dicarboxylic acid chloride derivatives and benzene derivatives. The compound wherein $A^{III}$ is constituent (3) of formula (III) can be synthesized by a condensation reaction between diphenylmethane derivatives and benzoyl chloride derivatives. Oxidation of the compound yields constituent (4) of formula (III).

The following examples illustrate the various methods to prepare the compounds represented by formula (III). Although only a few of the compounds encompassed by formula (III) are illustratively prepared below, methods similar to the methods described below can be used to synthesize the other compounds of formula (III).

III. Synthesis examples involving compounds of formula (III)

III-A. Synthesis of compound III-(19).

Into a 500 ml, three-necked, flask were placed 25.0 g (135 mmol) of p-nitrobenzoyl chloride, 20.0 g (150 mmol) of aluminum chloride, and 200 ml of methylene chloride. The mixture was stirred at −10° C. under a stream of nitrogen for 5 hours. A solution consisting of 9.25 g (55 mmol) of diphenylmethane and 50 ml of methylene chloride was slowly added dropwise over a period of about 40 minutes to the reaction mixture, followed by stirring for 2 hours. The mixture was stirred at room temperature for 15 hours and 10.0 g (75 ml) of aluminum chloride was added thereto, followed by refluxing for 24 hours. The reaction mixture was cooled and then was added to 300 g of ice. A 20% by weight of an aqueous potassium hydroxide solution was added to the reaction mixture until the aluminum hydroxide was dissolved. The organic layers were separated and the water phases were extracted with methylene chloride. All organic phases were collected and the solvent was removed under reduced pressure, followed by addition of about 300 ml of a 7% by weight of an aqueous potassium hydroxide solution. The mixture was heated for about one hour at about 70° C. on a water bath to decompose acid chlorides. The resulting precipitates were filtered off, and washed with ethyl acetate, thereby obtaining light yellow powders. Finally, recrystallization from ethanol and methylene chloride gave 11.8 g (a yield of 46.0%) of compound III-(19), a melting point of 193° to 195° C.

III-B. Synthesis of compound III-(2).

Into a 500 ml, three-necked, flask were placed 25.0 g (123 mmol) of terephthaloyl chloride, 40.0 g (300 mmol) of aluminum chloride, and 200 ml of methylene chloride. The mixture was stirred at −10° C. under a stream of nitrogen for 5 hours. A solution consisting of 35 g (261 mmol) of n-butylbenzene and 50 ml of methylene chloride was slowly added dropwise over a period of about one hour to the reaction mixture, followed by stirring for 30 minutes. To ice (200 g) was added the reaction mixture. A 20% by weight of an aqueous potassium hydroxide solution was added to the reaction mixture until the aluminum hydroxide was dissolved. The organic phases were separated and the water phases were extracted with methylene chloride. All organic layers were collected, and dried with $Na_2SO_4$, followed by removal of the solvent under reduced pressure.

Finally, recrystallization of the residue from ethanol gave 39.0 g (a yield of 79.4%) of compound III-(2) as colorless tabular crystals, a melting point of 111° to 112° C.

III-C. Synthesis of compound III-(12).

Into a 500 ml, three-necked, flask were placed 20 g (60.2 mmol) of a dicarboxylic acid having the following formula and 220 ml of thionyl chloride.

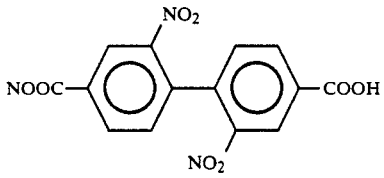

The reaction mixture was refluxed in a stream of nitrogen for 24 hours, followed by removal of the thionyl chloride. 50 ml of 1,2-dichloroethane was added to the reaction mixture, and the remained thionyl chloride was removed, thereby obtaining chlorides of the dicarboxylic acid as crude products.

To the chlorides of dicarboxylic acid were added 33 g (248 mmol) of aluminum chloride and 200 ml of methylene chloride, followed by stirring at −20° C. under a stream of nitrogen for 5 hours. A solution consisting of 17.4 g (130 mmol) of n-butylbenzene and 30 ml of methylene chloride was added dropwise to the reaction mixture for about 15 minutes. The mixture was stirred at room temperature for 15 hours. To ice (200 g) was added the reaction mixture. A 20% by weight of an aqueous potassium hydroxide solution was then added to the reaction mixture until the aluminum hydroxide was dissolved. The organic phases were separated and the water phases were extracted with methylene chloride. All organic layers were collected, and dried with $Na_2SO_4$. The dried product was then purified by the use of a short column of silica gel (in which methylene chloride was used as a solvent). After removal of the solvent under reduced pressure, recrystallization of the residue from methylene chloride and methanol was carried out. Further recrystallization from acetone and ethanol gave 17.3 g (51% yield) of compound III-(12) as light yellow acicular crystals, the melting point of 115° to 116.5° C.

In the electrophotographic photoreceptor of the present invention, the conductive substrate can be, for example, a metal pipe, a metal plate, a metal sheet, a metal film (foil), a polymer film conductive-treated, a polymer film provided with an evaporation layer of metal such as Al, metal oxides such as $SnO_2$, or a polymer film or paper coated with quaternary ammonium salts.

In the electrophotographic photoreceptor of the present invention, a photosensitive layer is formed on the conductive substrate. The photosensitive layer can be a single layer type, or a laminate layer type comprising a charge generating layer and a change transporting layer. A photosensitive layer of a single layer type includes, for example, a photosensitive layer comprising conventional materials such as polyvinylcarbazole and containing at least one of the compounds of formula (I), (II), or (III) as a sensitizer; or a photosensitive layer comprising a binder resin layer containing a conventional charge generating agent and containing at least one of the compounds of formula (I), (II), or (III) as an electron transporting agent.

In a laminated photosensitive layer, the charge generating layer can be obtained by various methods. For examples, the charge generating layer can be obtained by vapor-depositing a charge generating agent on a conductive substrate. Also, the charge generating layer can be formed by coating a solution containing a charge generating agent and a binder resin as main components on a conductive substrate. Any conventional charge generating agents and binder resins can be used. Suitable charge generating agents include inorganic semiconductor materials such as tri-Se, organic semiconductor materials such as polyvinyl carbazole, bis-azo compounds, tris-azo type compounds, phthalocyanines, pyrylium compounds, and organic pigments such as squarylium compounds. Suitable binder resins include polystyrenes, silicone resins, polycarbonate resins, acryl resins, methacrylate resins, polyesters, vinyl polymer, celluloses, and alkyd resins.

The thickness of the charge generating layer is from about 0.05 to 10 microns and preferably from about 0.05 to 5 microns.

The charge transporting layer is formed on the charge generating layer. The charge transporting layer comprises at least one of compounds represented by formula (I), (II), or (III) and a binder resin. In particular, the charge transporting layer is formed by coating on a charge generating layer a solution comprising at least one of compounds represented by formula (I), (II), or (III), a binder, and suitable solvents by the use of applicators, bar coaters, dip coaters, etc.

For photosensitive layers of both the single layer type and the laminate type, it is preferred that the ratio of the compound of formula (I), (II), or (III) to the binder resin is from about 1/20 to about 20/1 and most preferably from about 3/10 to 3/2.

The binder resin used in the charge transporting layer, can be of any conventional type. Examples of binder resins include styrene/butadiene copolymers, vinyltoluene/styrene copolymers, styrene modified alkyd resins, silicone modified alkyd resins, soybean oil modified alkyd resins, vinylidene chloride/vinyl chloride copolymers, polyvinyl butyrals, nitrated polystyrenes, polymethylstyrenes, polyisobutylenes, polyesters, phenolic resins, ketone resins, polyamides, polycarbonates, polythiocarbonates, polyvinyl haloallylates, vinyl acetate resins, polystyrenes, polyvinylacrylates, polysulfones, and polymethacrylates.

In a preferred embodiment, an electron donating material may be added to the charge transporting layer.

The thickness of the charge transporting layer is from about 2 to about 100 microns and preferably from about 10 to about 30 microns.

In the electrophotographic photoreceptor of the present invention, a barrier layer may be formed on the conductive substrate. The barrier layer prevents an injection of an undesirable charge from the conductive substrate and thus improves picture quality. The barrier layer can be made of such materials such as metal oxides (e.g., aluminum oxide), acrylic resins, phenolic resins, polyester resins, or polyurethanes.

The present invention will be illustrated in more detail by the following Examples.

EXAMPLES

Example I-1

A charge generating layer (2.5 microns) comprising trigonal system selenium/polyvinylcarbazole (trigonal system selenium content: 7% by volume) was formed on a conductive substrate. A solution made by dissolving 0.5 g of Compound I-(2) and 0.75 g of bisphenol A polycarbonate (Makrolon 5705 produced by Bayer Co.) in 7 g of methylene chloride was coated thereon in a wet thickness of 5 mil (i.e., a gap: 5 mil), and was then dried for one hour at 80° C., thereby obtaining an electrophotographic photoreceptor.

Using an electrostatic copying paper testing device ("SP428" produced by Kawaguchi Denki Manufacturing Co., Ltd.), the electrophotographic photoreceptor was charged to +800 V and −800 V, and was then exposed to a white light of 5 luxes, thereby measuring sensitivity (dv/dt). The results were as follows:

| Charged Potential | +800 V | −800 V |
|---|---|---|
| Initial Sensitivity (V/sec) | 85 | — |

Examples I-2 to I-10

Samples of electrophotographic photoreceptors were produced and their sensitivities were measured, respectively, in the same manner as in Example I-1 except that compounds represented by the above formulae I-(3), I-(4), I-(8), I-(11), I-(13), I-(18), I-(20), I-(22), and I-(24) were used in place of Compound I-(2). The results are shown in Table I-1.

Comparative Example I-1

A sample of electrophotographic photoreceptor was produced and its sensitivity was measured, respectively, in the same manner as in Example I-1 except that 2,4,7-trinitrofluorenone (TNF) was used in place of Compound I-(2). The result is shown in Table I-1.

TABLE I-1

| | Compound Added (Compound) No. | Initial Sensitivity +800 V | Initial Sensitivity −800 V |
|---|---|---|---|
| Example I-2 | I-(3) | 215 | — |
| Example I-3 | I-(4) | 253 | — |
| Example I-4 | I-(8) | 203 | — |
| Example I-5 | I-(11) | 198 | — |
| Example I-6 | I-(13) | 175 | — |
| Example I-7 | I-(18) | 154 | — |
| Example I-8 | I-(20) | 534 | — |
| Example I-9 | I-(22) | 431 | — |
| Example I-10 | I-(24) | 213 | — |
| Comparative I-1 Example | TNF | 66 | — |

Example I-11

A solution made by dissolving 0.5 g of Compound I-(2) and 0.75 g of polyvinylcarbazole in 7 g of methylene chloride was coated on a conductive substrate in a wet thickness of 5 mil (i.e., a gap: 5 mil), and was then dried for one hour at 80° C., thereby obtaining an electrophotographic photoreceptor.

Using an electrostatic copying paper testing device ("SP428" produced by Kawaguchi Denki Manufacturing Co., Ltd.), the electrophotographic photoreceptor was charged to +800 V and −800 V, and was then exposed to a white light of 5 luxes, thereby measuring the sensitivity (dv/dt). The results were as follows:

| Charged Potential | +800 V | −800 V |
|---|---|---|
| Initial Sensitivity (V/sec) | 195 | 164 |

Examples I-12 to I-20

Samples of electrophotographic photoreceptors were produced and their sensitivities were measured, respectively, in the same manner as in Example I-11 except that compounds represented by the above formula I-(3), I-(4), I-(8), I-(11), I-(13), I-(18), I-(20), I-(22), and I-(24) were used in place of Compound I-(2). The results are shown in Table I-2.

Comparative Example I-2

A sample of electrophotographic photoreceptor was produced and its sensitivity was measured, respectively, in the same manner as in Example I-11 except that 2,4,7-trinitrofluorenone (TNF) was used in place of Compound I-(2). The result is shown in Table I-2.

TABLE I-2

| | Compound Added (Compound) No. | Initial Sensitivity +800 V | Initial Sensitivity −800 V |
|---|---|---|---|
| Example I-12 | I-(3) | 352 | 159 |
| Example I-13 | I-(4) | 385 | 178 |
| Example I-14 | I-(8) | 401 | 181 |
| Example I-15 | I-(11) | 350 | 181 |
| Example I-16 | I-(13) | 255 | 162 |
| Example I-17 | I-(18) | 212 | 154 |
| Example I-18 | I-(20) | 575 | 193 |
| Example I-19 | I-(22) | 529 | 172 |
| Example I-20 | I-(24) | 314 | 185 |
| Comparative Example I-2 | TNF | 154 | 165 |

As is apparent from a comparison between Examples I-1 to I-20 and Comparative Examples I-1 to I-2, the compounds of formula (I) which are used in the present invention exhibit greatly improved charge transporting ability as compared with TFN which is already known as having good change transporting ability. Accordingly, the electrophotographic photoreceptors containing the compounds of formula (I) exhibit excellent electrophotographic properties. In particular, when the compounds of formula (I) are used as charge transporting agents in the charge transporting layer of a laminate type electrophotographic photoreceptor, a positive charged type electrophotographic photoreceptor having excellent electrophotographic properties can be obtained.

Example II-1

A charge generating layer (2.5 microns) comprising trigonal system selenium/polyvinylcarbazole (trigonal system selenium content: 7% by volume) was formed on a conductive substrate. A solution made by dissolving 0.5 g of Compound II-(1) and 0.75 grams of bisphenol A polycarbonate (Makrolon 5705 by Bayer Co.) in 7 g of methylene chloride was coated thereon in a wet thickness of 5 mil (i.e., a gap: 5 mil), and was then dried for one hour at 80° C., thereby obtaining an electrophotographic photoreceptor.

Using an electrostatic copying paper testing device ("SP428" produced by Kawaguchi Denki Manufacturing Co., Ltd.), the electrophotographic photoreceptor was charged to +800 V and −800 V, and was then exposed to a white light of 5 luxes, thereby measuring sensitivity (dv/dt). The results were as follows:

| Charged Potential | +800 V | −800 V |
|---|---|---|
| Initial Sensitivity (V/sec) | 93 | — |

Examples II-2 to II-4

Samples of electrophotographic photoreceptors were produced and their sensitivities were measured, respectively, in the same manner as in Example II-1 except that compounds represented by the above formulae II-(3), II-(9), and II-(13) were used in place of Compound II-(1). The results are shown in Table II-1.

Comparative Example II-1

A sample of electrophotographic photoreceptor was produced, and its sensitivity was measured, respectively, in the same manner as in Example II-1 except that 2,4,7-trinitrofluorenone (TNF) was used in place of Compound II-(1). The result is shown in Table II-1.

TABLE II-1

| | Compound Added (Compound) No. | Initial Sensitivity +800 V | Initial Sensitivity −800 V |
|---|---|---|---|
| Example II-2 | I-(3) | 82 | — |
| Example II-3 | I-(9) | 115 | — |
| Example II-4 | I-(13) | 71 | — |
| Comparative Example II-1 | TNF | 66 | — |

Example II-5

A solution made by dissolving 0.5 g of Compound II-(1) and 0.75 g of polyvinylcarbazole in 7 g of methylene chloride was coated on a conductive substrate in a wet thickness of 5 mil (i.e., a gap: 5 mil), and was then dried for one hour at 80° C., thereby obtaining an electrophotographic photoreseptor.

Using an electrostatic copying paper testing device ("SP428" produced by Kawaguchi Denki Manufacturing Co., Ltd.), the electrophotographic photoreceptor was charged to +800 V and −800 V, and was then exposed to a white light of 5 luxes, thereby measuring sensitivity (dv/dt). The results were as follows:

| Charged Potential | +800 V | −800 V |
|---|---|---|
| Initial Sensitivity (V/sec) | 195 | 184 |

Examples II-6 to II-8

Samples of electrophotographic photoreceptors were produced and their sensitivities were measured, respectively, in the same manner as in Example II-5 except that compounds represented by the above formulae II-(3), II-(9), and II-(13) were used in place of Compound II-(1). The results are shown in Table II-2.

Comparative Example II-2

An electrophotographic photoreceptor was produced and its sensitivity was measured, respectively, in the same manner as in Example II-5 except that 2,4,7-trinitrofluorenone (TNF) was used in place of Compound II-(1). The result is shown in Table II-2.

TABLE II-2

| | Compound Added (Compound) No. | Initial Sensitivity +800 V | −800 V |
|---|---|---|---|
| Example II-6 | I-(3) | 175 | 170 |
| Example II-7 | I-(9) | 234 | 184 |
| Example II-8 | I-(13) | 169 | 152 |
| Comparative II-2 Example | TNF | 154 | 165 |

As is apparent from a comparison between Examples II-1 to II-S and Comparative Examples II-1 to II-2, the compounds of formula (II) which are used in the present invention exhibit greatly improved charge transporting ability as compared with TNF which is already known as having good charge transporting ability. Accordingly, the electrophotographic photoreceptors containing the compounds of formula (II) exhibit excellent electrophotographic properties. In particular, when the compounds of formula (II) are used as charge transporting agents in the charge transporting layer of a laminate type electrophotographic photoreceptor, a positive charged type electrophotographic photoreceptor having excellent electrophotographic properties can be obtained.

Example III-1

A charge generating layer (2.5 microns) comprising trigonal system selenium/polyvinylcarbazole (trigonal system selenium content: 7% by volume) was formed on a conductive substrate. A solution made by dissolving 0.5 g of Compound III-(2) and 0.75 g of in 7 g of methylene chloride was coated thereon in a wet thickness of 5 mil (i.e., a gap: 5 mil), and was then dried for one hour at 80° C., thereby obtaining an electrophotographic photoreceptor.

Using an electrostatic copying paper testing device ("SP428" produced by Kawaguchi Denki Manufacturing Co., Ltd.), the electrophotographic photoreceptor was charged to +800 V and −800 V, and was then exposed to a white light of 5 luxes, thereby measuring sensitivity (dv/dt). The results were as follows:

| Charged Potential | +800 V | −800 V |
|---|---|---|
| Initial Sensitivity (V/sec) | 84 | — |

Examples III-2 to III-9

Samples of electrophotographic photoreceptors were produced and their sensitivities were measured, respectively, in the same manner as in Example III-1 except that compounds represented by the above formulae III-(3), III-(4), III-(10), III-(12), III-(17), III-(19), III-(21), and I-(24) were used in place of Compound III-(2). The results are shown in Table III-1.

Comparative Example III-1

An electrophotographic photoreceptor was produced and its sensitivity was measured, respectively, in the same manner as in Example III-1 except that 2,4,7-trinitrofluorenone (TNF) was used in place of Compound III-(2). The result is shown in Table III-1.

TABLE III-1

| | Compound Added (Compound) No. | Initial Sensitivity +800 V | −800 V |
|---|---|---|---|
| Example III-2 | III-(3) | 175 | — |
| Example III-3 | III-(4) | 189 | — |
| Example III-4 | III-(10) | 165 | — |
| Example III-5 | III-(12) | 154 | — |
| Example III-6 | III-(17) | 193 | — |
| Example III-7 | III-(19) | 254 | — |
| Example III-8 | III-(21) | 234 | — |
| Example III-9 | III-(24) | 147 | — |
| Comparative III-1 Example | TNF | 66 | — |

Example III-10

A solution made by dissolving 0.5 g of Compound III-(2) and 0.75 g of polyvinylcaraozole in 7 g of methylene chloride was coated on a conductive substrate in a wet thickness of 5 mil, and was then dried for one hour at 80° C., thereby obtaining an electrophotographic photoreceptor.

Using an electrostatic copying paper testing device ("SP428" produced by Kawaguchi Denki Manufacturing Co., Ltd.), the electrophotographic photoreceptor was charged to +800 V and −800 V, and was then exposed to a white light of 5 luxes, thereby measuring the sensitivity (dv/dt). The results were as follows:

| Charged Potential | +800 V | −800 V |
|---|---|---|
| Initial Sensitivity (V/sec) | 174 | 171 |

Examples III-11 to III-18

Samples of electrophotographic photoreceptors were produced and their sensitivities were measured, respectively, in the same manner as in Example III-10 except that compounds represented by the above formula III-(3), III-(4), III-(10), III-(12), III-(17), III-(19), III-(21), and III-(24) were used in place of Compound III-(2). The results are shown in Table III-2.

Comparative Example I-2

An electrophotographic photoreceptor was produced and its sensitivity was measured, respectively, in the same manner as in Example III-10 except that 2,4,7-trinitrofluorenone (TNF) was used in place of Compound III-(2). The result is shown in Table III-2.

TABLE III-2

| | Compound Added (Compound) No. | Initial Sensitivity +800 V | −800 V |
|---|---|---|---|
| Example III-11 | III-(3) | 205 | 183 |
| Example III-12 | III-(4) | 234 | 162 |
| Example III-13 | III-(10) | 172 | 154 |
| Example III-14 | III-(12) | 155 | 163 |
| Example III-15 | III-(17) | 206 | 170 |
| Example III-16 | III-(19) | 305 | 155 |
| Example III-17 | III-(21) | 298 | 159 |
| Example III-18 | III-(24) | 162 | 175 |
| Comparative III-2 Example | TNF | 154 | 165 |

As is apparent from a comparison between Examples III-1 to III-18 and Comparative Examples III-1 to III-2, the compounds of formula (III) which are used in the present invention exhibit greatly improved charge transporting ability as compared with TFN which is already known as having good change transporting ability. Accordingly, the electrophotographic photoreceptors containing the compounds of formula (III) exhibit excellent electrophotographic properties. In particular, when the compounds of formula (III) are used as charge transporting agents in the charge transporting layer of a laminate type electrophotographic photoreceptor, a positive charged type electrophotographic photoreceptor having excellent electrophotographic properties can be obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a conductive substrate having thereon a photosensitive layer wherein the photosensitive layer comprises a charge generating material and at least one compound selected from the group consisting of a compound of formula (I), a compound of formula (II), and a compound of formula (III):

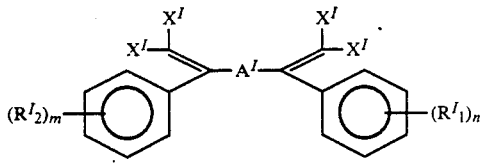

(I)

wherein $X^I$ represents a cyano group, an alkoxycarbonyl group, or an aryloxycarbonyl group, $R_1^I$ and $R_2^I$ each represents a hydrogen atom, an alkyl group, an aryl group, an alkoxycarbonyl group, an aryloxycarbonyl group, an alkylcarbonyl group, an arylcarbonyl group, a nitro group, a halogen atom, or a cyano group, $A^I$ represents

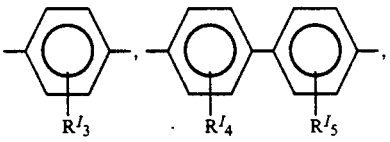

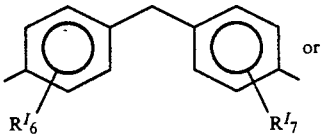

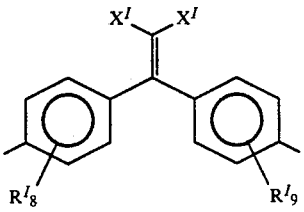

wherein $R_3^I$ to $R_9^I$ each represents a hydrogen atom, an alkyl group, a nitro group, a halogen atom, or a cyano group, and m and n each represents an integer of 0 to 3;

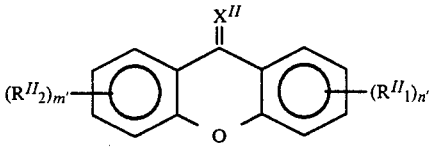

(II)

wherein $X^{II}$ represents O, $C(CN)_2$ or $C(CO_2R^{II})_2$, wherein $R^{II}$ is an alkyl group, $R_1^{II}$ and $R_2^{II}$ each represents a hydrogen atom, an alkyl group, an aryl group, an alkoxycarbonyl group, an aryloxycarbonyl group, a nitro group, a halogen atom, or a cyano group, and m' and n' each represents an integer of 0 to 2; and

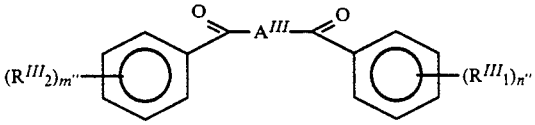

(III)

wherein $R_1^{III}$ and $R_2^{III}$ each represents a hydrogen atom, an alkyl group, an aryl group, an alkoxycarbonyl group, an aryloxycarbonyl group, an alkoxycarbonyl group, an arylcarbonyl group, a nitro group, a halogen atom, or a cyano group, $A^{III}$ represents

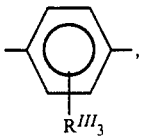

(1)

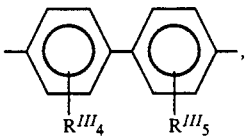

(2)

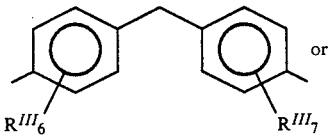

(3)

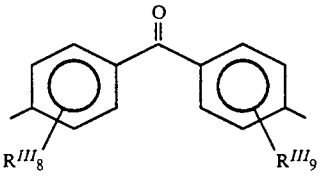

(4)

wherein $R_3^{III}$ and $R_9^{III}$ each represents a hydrogen atom, an alkyl group, a nitro group, a halogen atom, or a cyano group, and m'' and n'' each represents an integer of 0 to 3.

2. The electrophotographic photoreceptor as claimed in claim 1, wherein the photosensitive layer additionally comprises a binder resin in which a ratio of said compound to the binder resin is from about 1/20 to about 20/1.

3. The electrophotographic photoreceptor as claimed in claim 2, wherein the ratio between said compound to the binder resin is about 3/10 to 3/2.

4. The electrophotographic photoreceptor as claimed in claim 1, wherein the photosensitive layer additionally comprises a binder resin.

5. The electrophotographic photoreceptor as claimed in claim 1, wherein the photosensitive layer comprises a charge generating layer and a charge transporting layer.

6. The electrophotographic photoreceptor as claimed in claim 5, wherein the charge generating layer has a thickness of from about 0.05 to about 10 microns and the charge transporting layer has a thickness of from about 2 to about 100 microns.

7. The electrophotographic photoreceptor as claimed in claim 6, wherein the charge generating layer has a thickness of from about 0.05 to about 5 microns and the charge transporting layer has a thickness of from about 10 to about 30 microns.

8. The electrophotographic photoreceptor as claimed in claim 1, wherein for the compounds of formulas (I), (II), and (III), the alkyl group has from 1 to 10 carbon atoms, the aryl group has from 6 to 25 carbon atoms, the alkoxycarbonyl group has from 2 to 11 carbon atoms, the aryloxycarbonyl group has from 7 to 26 carbon atoms, the arylcarbonyl group has from 7 to 26 carbon atoms, and the alkylcarbonyl group has from 2 to 11 carbon atoms.

9. A photosensitive layer useful in an electrophotographic photoreceptor comprising a compound of formula (I), (II), or (III) as set forth in claim 1.

10. The electrophotographic photoreceptor as claimed in claim 1, wherein the photosensitive layer is of a single layer type.

* * * * *

UNITED STATES PATENT AND TRADEMARK OFFICE

CERTIFICATE OF CORRECTION

PATENT NO. : 5,028,505

DATED : July 02, 1991

INVENTOR(S) : Yutaka AKASAKI et al.

It is certified that error appears in the above-identified patent and that said Letters Patent is hereby corrected as shown below:

Claim 1, column 21, line 38, change "$R_1^I$ and $R_2^I$" to --$R^I_1$ and $R^I_2$--.

Claim 1, column 21, line 67, change "$R_3^I$ to $R_9^I$" to --$R^I_3$ to $R^I_9$--.

Claim 1, column 22, line 12, change "$R_1^{II}$ and $R_2^{II}$, to --$R^{II}_1$ and $R^{II}_2$--.

Claim 1, column 22, line 24, change "$R_1^{III}$ and $R_2^{III}$" to --$R^{III}_1$ and $R^{III}_2$, --.

UNITED STATES PATENT AND TRADEMARK OFFICE

CERTIFICATE OF CORRECTION

PATENT NO. : 5,028,505

DATED : July 02, 1991

INVENTOR(S) : Yutaka Akasaki et al

It is certified that error appears in the above-identified patent and that said Letters Patent is hereby corrected as shown below:

Claim 1, column 22, line 26, change "alkoxycarbonyl" to --alkylcarbonyl--.

Claim 1, column 22, line 57, change "$R_3^{III}$ and $R_9^{III}$" to --$R^{III}_3$ and $R^{III}_9$--.

Signed and Sealed this

Sixth Day of April, 1993

*Attest:*

STEPHEN G. KUNIN

*Attesting Officer*

*Acting Commissioner of Patents and Trademarks*